United States Patent [19]

Benedick

[11] 4,454,826

[45] Jun. 19, 1984

[54] VERTICAL FLOW INCINERATOR HAVING REGENERATIVE HEAT EXCHANGE

[75] Inventor: Edward H. Benedick, Lancaster, Pa.

[73] Assignee: Regenerative Environmental Equipment Co., Inc., Morris Plains, N.J.

[21] Appl. No.: 391,110

[22] Filed: Jun. 23, 1982

[51] Int. Cl.[3] ..... F23B 5/00; F23C 9/00; F23G 7/06

[52] U.S. Cl. ..... 110/211; 422/170; 422/175; 422/182; 431/5

[58] Field of Search ..... 110/203, 210, 211, 212, 110/213, 214; 422/170, 171, 175, 182; 431/5

[56] References Cited

U.S. PATENT DOCUMENTS

| | | | |
|---|---|---|---|
| 3,895,918 | 7/1975 | Mueller | 110/203 |
| 3,923,956 | 12/1975 | Bowman | 422/182 |
| 4,252,070 | 2/1981 | Benedick | 110/211 |
| 4,353,720 | 10/1982 | Margraf | 422/171 |

*Primary Examiner*—Edward G. Favors
*Assistant Examiner*—Steven E. Warner
*Attorney, Agent, or Firm*—Nelson E. Kimmelman

[57] ABSTRACT

A vertical incinerator has three or more adjacent, stationary, heat-exchange sections which communicate, via respective plenums, with a common high-temperature combustion chamber positioned above them. Inlet and outlet valving to each heat-exchange section is provided and operated so that when effluent from an industrial process is fed upwardly through one of the sections to the combustion chamber, at least one other section is operating in an exhaust mode to withdraw the products of combustion downward through it thereby recapturing some of the generating heat.

In order to prevent upwardly moving effluent from substantially short-circuiting the combustion chamber, each section is provided with a cover having an aperture which produces a jet effect. Thus, the relatively low velocity effluent stream from the industrial process applied through the aperture in the cover of the first section has its velocity increased, for example, 3-5 times as it enters the combustion chamber. The effluent moves in jet form toward the top of the combustion chamber causing some turbulent gas movement in the latter and insuring a prescribed minimum residence time for the effluent in that chamber. Thus its noxious components will have been thoroughly oxidized before they are sucked out through a second section operating in the exhaust mode.

11 Claims, 5 Drawing Figures

VERTICAL FLOW INCINERATOR HAVING REGENERATIVE HEAT EXCHANGE

BACKGROUND OF THE INVENTION

A. FIELD OF THE INVENTION

This invention relates to incinerators and, especially to stationary, vertical incinerators having a number of heat-regenerative sections topped by a common combustion chamber.

B. PRIOR ART

Stationary incinerators using the heat-regenerative principle are known in the art. U.S. Pat. No. 3,895,918 to James H. Mueller, issued July 22, 1975 teaches and claims incineration apparatus in which there is a central, high-temperature combustion chamber with three or more heat-exchange sections arranged around it which communicate with the chamber. Each heat-exchange section includes a large number of saddle-shaped, foı example, ceramic elements confined between two substantially vertical apertured retaining walls which were often, in the past, made of apertured metal. Inlet and outlet valves associated with each section were so arranged and operated that when the effluent entered one section substantialy horizontally through its heat-exchange bed, the exhaust valve thereof was closed. At least one other heat-exchange section had its inlet valve closed and its outlet valve, connected to an exhaust fan, open.

While such structures have proved eminently satisfactory and have been commercially successful, certain of its design features imposed rigorous demands on its materials and structural characteristics. For example, in certain ones of those incinerators, the apertured metallic retaining wall for the heat-exchange elements which faced the high-temperature central combustion chamber had to have very high resistance to heat and extreme strength to offset the lateral pressure exerted by the thousands of ceramic elements within the bed partially confined by it. It was often necessary to employ special steels in sufficiently thick gauges which could resist heat, as well as tie-rods, holding pins, springs and leg supports to insure its geometric integrity under such extreme heat and pressure conditions.

The input and exhaust ducts which communicated individually with each of the heat-exchange sections in that prior construction were attached to the sides of the sections at relatively large heights. This made them somewhat more difficult to maintain than if they had been closer to the ground. To compensate for the subsidence over time of the ceramic elements in each bed due to gas velocity, expansion and contraction, etc., these former types of incinerators often required the use of a special fill hatch for charging the bed with additional ceramic elements. These features of some of the prior art structures rendered them quite costly to build and maintain.

As an alternative to the central combustion chamber with flow through it from heat-exchange sections located outwardly thereof, vertical incinerators came into use. Within a cylindrical shell, for example, there were three or more heat-exchange sections having respective generally pie shaped cross-sections into which the heat-exchange elements were placed. Above all the separate heat-exchange sections, each with their own inlet and outlet valves, there was a common combustion chamber. Effluent gases were fed into the bottom of a first of the adjacent heat-exchange sections at relatively low velocity, e.g., 750 ft/min. The gases passed upwardly through the first heat-exchange bed and into the common combustion chamber. Since at least one other of the heat-exchange sections had its inlet valve closed and its outlet valve (coupled to a suction fan) open, no effluent could enter that bed, but the high-temperature products of combustion from the combustion chamber would be pulled downward through it to exhaust. One of the problems encountered with such types of vertical incinerators was the fact that, since the effluent gas entered the combustion chamber at relatively low velocity, it would seek the shortest path within the chamber, i.e., to the adjacent bed operating in the exhaust mode, to exhaust. Therefore, the effluent did not remain in the combustion chamber for sufficient time to permit its substantially complete combustion at the high temperatures involved. Consequently, gases exhausted through the second bed were not raised to the proper temperature to sufficiently purify them and so when they passed through the ceramic elements in the second bed, those elements were insufficiently heated to preheat the effluent when applied to that bed during its next cycle of operation as an inlet heat-exchange section.

It is therefore among the objects of the present invention to provide:

1. A stationary, vertical-flow incinerator of the heat-regenerative type in which the effluent gas being processed is made to reside within the common combustion chamber for a time sufficient to purify it by incineration.

2. Incineration apparatus in which relatively low velocity effluent gas input flow is converted to relatively high velocity as it enters the combustion chamber so as to produce more gaseous turbulence in that chamber thereby helping to insure attainment of the proper residence time for the effluent in that chamber as well as production of more even heat distribution therein.

3. A stationary, vertical flow incinerator of the heat-regenerative type of simplified and relatively less expensive construction.

SUMMARY OF THE INVENTION

Thermal recovery incineration apparatus which comprises a plurality of adjacent, substantially vertical gas-processing sections each of which includes heat-exchange means having a predetermined cross-sectional area, each section also having a cover with aperture means formed therein whose area is substantially smaller than said predetermined area.

DETAILED DESCRIPTION OF THE DRAWINGS

Figure 1:
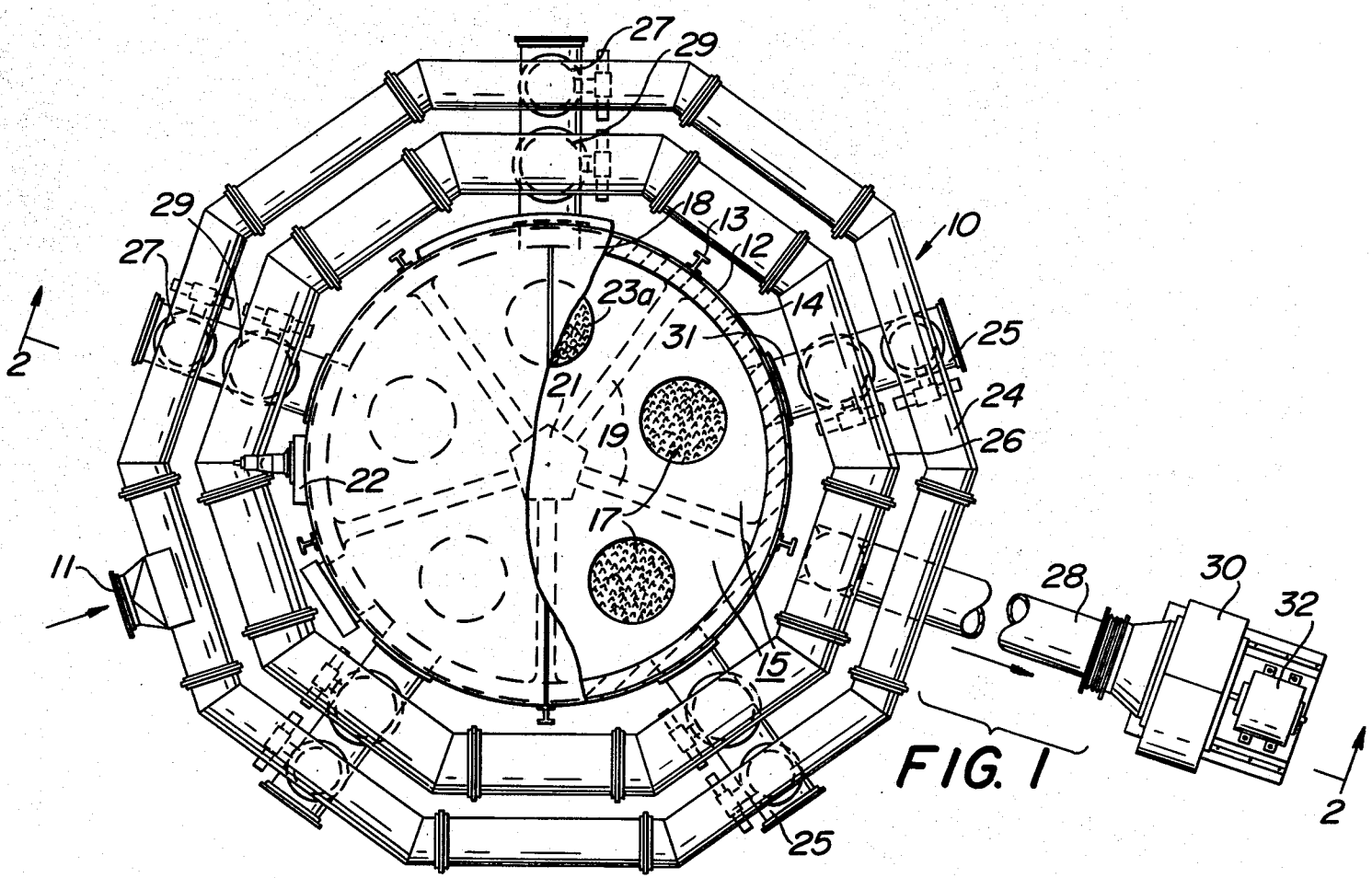
FIG. 1 is a plan view, partly sectional and partly broken-away, of one form of the present invention.
Figure 2:
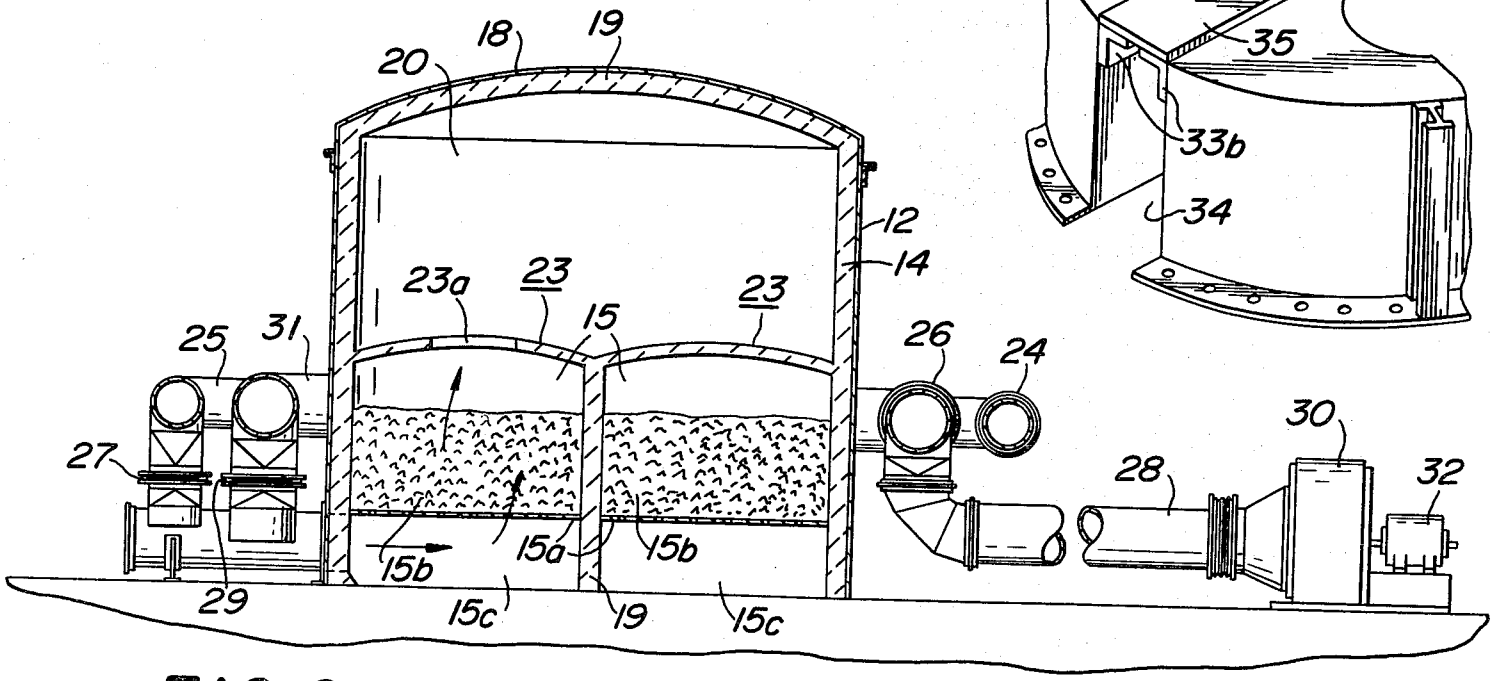
FIG. 2 is a sectional view of the form of the invention shown in FIG. 1 taken along section line 2—2 therein.

Referring to FIGS. 1 and 2 there is shown generally at the numeral 10 one form of the present invention which includes a generally cylindrical metallic outer shell 12 having a refractory lining 14 which is topped by a dome-like cover having a steel external sheath 18 and a refractory lining 19.

The lower half of the interior volume of the structure 12 is divided, in the case shown, into five generally pie-shaped heat-exchange sections. The five heat-exchange sections shown generally at 15 are divided by vertical refractory dividing walls 19 radiating outwardly from the center post 21. Structure 12 is maintained in upright position with the aid of I-beams 13.

Within each of the sections 15, there is a pile **15*b* of ceramic, generally saddle-shaped elements 17 such as those manufactured by the Norton Chemical Company under the mark "Interlox", supported on respective perforated or expanded metallic (or other suitable rigid material) plates 15*a* which, in turn, are fixed to the center post 21 and to the inside surfaces of the refractory wall 14. A burner 22 protrudes through sidewalls 12, 14 into the combustion chamber 20 and is supplied with natural gas or other fuel, its function being to produce within combustion chamber 20 a very high temperature, on the order of 1500° F. or thereabouts. Spaces 15*c* are formed below the beds into which effluent of an industrial process is introduced via input duct 11 when the associated inlet valve is open. Input duct 11 communicates with the input toroidal distribution duct 24 that is itself coupled to each of the heat-exchange sections 15 by radial feeding ducts 25 through respective valves 27. Also coupled to each of the sections 15 are radial outlet ducts 31 which communicate via valves 29 with the exhaust toroidal duct 26 that is coupled via outlet duct 28 to a centrifugal blower 30 driven by motor 32. The inlet feeders 25 and the exhaust or output ducts 31 are associated with respective inlet and outlet valves 27 and 29. The output of the centrifugal fan 30** is applied to a stack or to the ambient atmosphere.

In accordance with the present invention, the upper surfaces of the piles of ceramic elements 17 are separated a substantial distance from the covers 23 for each section. The covers 23 themselves have respective apertures **23*a* formed therein which are considerably smaller than the respective cross-sections of the beds 15*b*. If the covers 23 were not used but, instead, the entire top surfaces of the beds were exposed to the combustion chamber 20, the effluent at the input 11 would flow into the chamber through a bed at the rate of about 750 feet per minute. Then, after rising to the top of the bed, the effluent would seek the shortest (and lowest) path to the closest section 15 which is operating in the exhaust mode, i.e., with its inlet valve 27 closed and its outlet valve 29 open. Thus, the effluent would just surmount the dividing walls between the sections and would not reside in chamber 20** sufficiently long to be brought to the highest or very high temperature produced therein and would not be oxidized sufficiently to produce a sufficiently purified exhaust.

In accordance with the present invention, the provision of the covers 23 with their restricted apertures **23*a* transforms the relatively slow-moving input effluent into a much higher velocity, e.g., to 2,000–3,000 ft/minute, upward stream of gas through the aperture 23*a*. This will have two important effects: (1) the sharp rising stream will tend to introduce turbulence into the gases within the combustion chamber 20 thereby helping to insure a good gas mixture and more uniform heat distribution and (2) will prevent short-circuiting and low arcing-over of the effluent from the top of the pile 15*b* of one heat exchange section operating in an inlet mode to the top of the pile 15*b*** of an adjacent heat-exchange section operating in an exhaust mode.

In the form of the invention shown in FIGS. 1 and 2, the dividing vertical walls 19 of the pie-shaped sections are made of refractory material. Due to thermal shock, and possibly to the destructive effect of the effluents passing through the beds and other reasons, these refractory partition walls may have a tendency to crack. This would allow the effluent to short circuit the combustion chamber by permitting the effluent to pass directly from an inlet mode chamber to an outlet mode chamber and hence escape oxidation.

Figure 3:
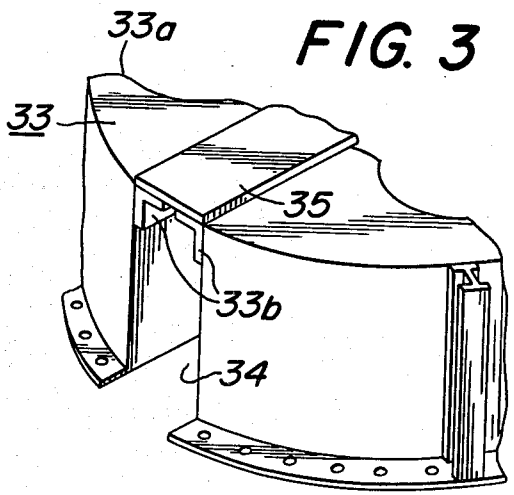
FIG. 3 is a fragmentary, isometric view of a modification of the form of the invention shown in Figs. 1 and 2.

In another form of the invention, as shown in FIG. 3, the heat-exchange sections are composed of a plurality of pie-shaped metallic containers 33 mounted by flange **33*d* to the floor. Each has a cover 33*a* with a central aperture 33*c* and would be spaced from the adjacent one by, say, 8–12 inches. Thus, the side walls of each would be separated and would be kept cooler than the refractory walls 19 of the embodiment of FIGS. 1 and 2. The tops of the straight walls of the pie-shaped sections 33 would have fixed thereto L-shaped flange pieces 33*b* so dimensioned that the edges of the flanges would be slightly separated from one another. On top of those flanged sections, rectangular slabs 35 would be connected by any desired welding, bolt, or other appropriate metal fastening method. If desired, the space 34 between adjacent pie-shaped sections could be flushed with air or purified exhaust. This would have the advantage of pre-heating the vertical straight walls thereby helping to conserve heat. Since those walls would be at a lower temperature and made of metal, the possibility of leaks due to fractures in vertical adjacent walls as shown in Figs. 1 and 2** is considerably reduced.

Figure 4:
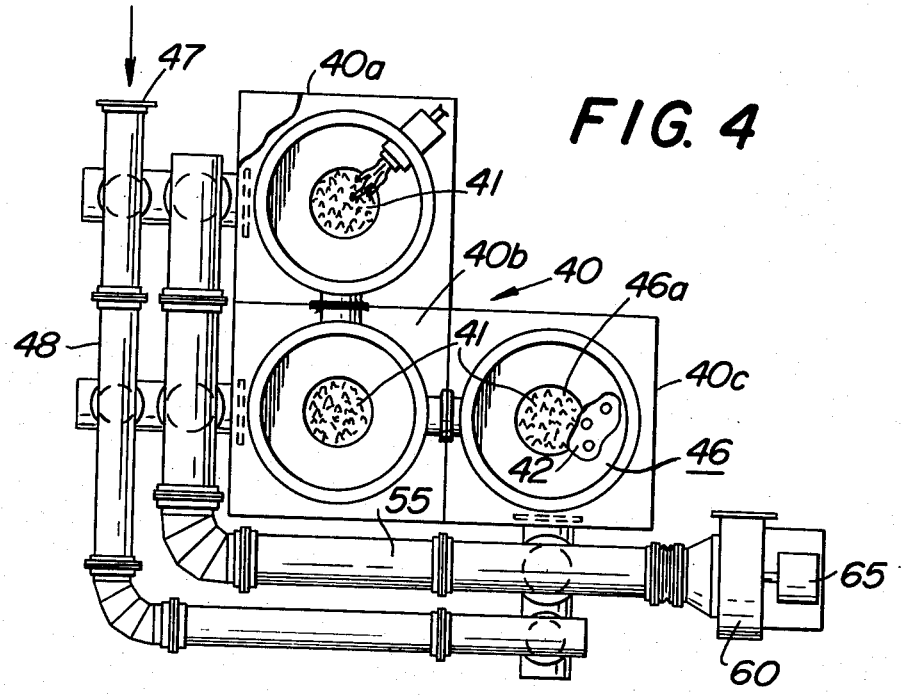
FIG. 4 is a plan view of still another form of the present invention.
Figure 5:
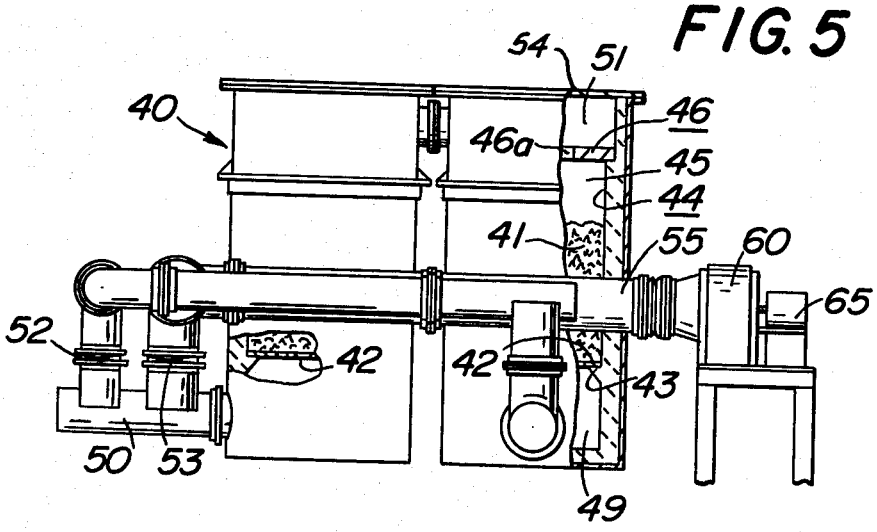
FIG. 5 is a side-elevation view, partly brokenaway and sectional, corresponding to the form of the invention shown in FIG. 4.

FIGS. 4 and 5 show another embodiment of the present invention in which the apparatus as viewed in plan assumes a generally L-shaped configuration. The apparatus indicated generally at the numeral 40 comprises three contiguous vertical structures **40*a*, 40*b* and 40*c* having respectively a substantially square cross-section arranged as shown. In each of the sections 40*a*–40*c*, there is a pile of heat-exchange ceramic elements or "stones" 41 supported from beneath by an apertured or expanded metal support or shelf 42 which itself is resting upon a shoulder 43 formed in the inner side wall 44. A plenum 45 is provided between the top surface of each pile 41 and each section has a refractory cover 46 having a central aperture 46*a*** intended to provide the jet effect as described above.

Effluent from an industrial process is applied at the inlet 47 and passes through the generally L-shaped inlet distribution duct 48 that is coupled by feeder ducts 50 to the spaces 49 below the apertured supporting structure 43. If the effluent is to be applied to the bed of section **40*a*, its inlet valve 52 will be open and its exhaust or outlet valve will be closed. The effluent as applied to the feeder ducts 50 is at a relatively low speed and as it goes upward through the particular bed 41 in section 40*a*, it is accelerated to a much higher velocity by the jet effect introduced by passage through aperture 46 thereby making for better heat distribution and gas mixture in the combustion chamber 51**. Simultaneously, it is preheated in its ascent.

After being oxidized by high temperature within the combustion chamber 51, the effluent is then drawn out of the apparatus 40 downward through the aperture in the cover of an adjacent one of the sections **40*a*–40*c*. In that adjacent section the associated outlet valve 53 is open and its inlet valve is closed thereby coupling the L-shaped exhaust duct 55 to the space 49 below that bed. The duct 55 is itself coupled to the exhaust blower 60 driven by motor 65. The production of the high pressure stream prevents short-circuiting of the effluent gas in a low path from the top of one bed 41** to the top and down through an adjacent bed in an exhaust mode.

While the invention as shown has utilized a single round aperture (23*a*, 46*a*) for each heat-exchange section, they can be any shape or, even, be in the form of several smaller apertures clustered together. Generally speaking, whether unitary or in clusters, their aggregate area for each section should be about one-quarter of the aggregate area of the cross-section of the section with which they are associated, although this will depend on a number of other factors, i.e., the height and geometry of the common combustion chamber, the rate of gas flow as determined by the blower, etc.

What is claimed is:

1. Thermal recovery incineration apparatus comprising:

(a) a plurality of adjacent, substantially parallel and vertical gas-processing sections each of which includes:

(1) a positionally fixed heat exchange means having a plurality of normally immobile heat exchange elements therein, a predetermined cross-sectional area, and (2) a cover for said sections with aperture means formed therein whose area is substantially smaller than said predetermined area, and (b) a high temperature combustion chamber disposed above said sections and in gas-flow communication therewith through said aperture means.

2. The incineration apparatus according to claim 1 wherein there are at least three of said gas processing sections.

3. The incineration apparatus according to claim 1 wherein each processing section includes a plenum formed above said heat exchange means and below said covers through which upwardly-flowing gases pass from said heat-exchange means and through said aperture means to said combustion chamber.

4. The incineration apparatus according to claim 1 wherein said covers are generally dome-shaped and wherein said aperture means comprise generally centrally located openings therein.

5. The incineration apparatus according to claim 2 wherein said sections have respective cross-sections in the form of sectors of a circle, said sectors being arranged radially about the vertical axis of said apparatus.

6. The incineration apparatus according to claim 5 wherein said sections have common vertical dividing walls made of a refractory material.

7. The incineration apparatus according to claim 5 wherein each of said sections has respective vertical side walls separated by respective spaces from the vertical side walls of the sections adjacent thereto, said vertical side walls being made of a heat-conducting material.

8. The incineration apparatus according to claim 1 wherein inlet and outlet concentric circular ducts are provided and surround said gas-processing sections.

9. The incineration system according to claim 8 wherein a plurality of generally horizontal feed ducts are respectively coupled to said circular ducts at each processing section and are also respectively coupled to the latter below said heat exchange means, said feeder ducts being provided with respective valves where they are coupled to said circular ducts.

10. The incineration system according to claim 2 wherein generally L-shaped distribution ducts are arranged parallel to one another and to two adjacent sides of said processing sections and further wherein each section is provided with duct means coupling a point in it below its heat exchange means to both of said L-shaped ducts via respective valve means.

11. The incineration apparatus according to claim 1 wherein there are at least two of said gas processing sections.

* * * * *